United States Patent [19]

Craft et al.

[11] 3,980,296

[45] Sept. 14, 1976

[54] DUPLICATING MACHINE EMPLOYING IMAGE REVERSING OPTICAL PATHS WITH FRONT EDGE DOCUMENT ALIGNMENT ON DOCUMENT INPUT AND OUTPUT

[75] Inventors: James Alexander Craft, Lexington, Ky.; James Charles Rogers, Boulder, Colo.

[73] Assignee: International Business Machines Corporation, Armonk, N.Y.

[22] Filed: May 30, 1975

[21] Appl. No.: 582,510

[52] U.S. Cl. ..... 271/251; 271/184; 355/8

[51] Int. Cl.[2] ..... B65H 9/14

[58] Field of Search ..... 271/184, 240, 250, 251; 355/8

[56] References Cited

UNITED STATES PATENTS

| | | | |
|---|---|---|---|
| 3,494,525 | 2/1970 | Wiig | 271/251 |
| 3,656,848 | 4/1972 | Bentzman | 355/8 |
| 3,866,906 | 2/1975 | Berry | 271/250 |

*Primary Examiner*—Robert W. Saifer
*Attorney, Agent, or Firm*—Herbert F. Somermeyer

[57] ABSTRACT

A document reproduction machine, such as an electrostatic copier, has a copy station with a front reference edge for operator convenience. A reproduction station adjacent the copy station reverses the image such that the reference edge is at a rear or remote position from the operator. The duplicate copy is initially referenced to the rear reference edge. An aligner in a transfer station moves the duplicate copy to a front reference edge and into an exit station which may include a collator. In a minimal transport distance, documents of various lengths are automatically handled and aligned by the apparatus.

6 Claims, 8 Drawing Figures

DUPLICATING MACHINE EMPLOYING IMAGE REVERSING OPTICAL PATHS WITH FRONT EDGE DOCUMENT ALIGNMENT ON DOCUMENT INPUT AND OUTPUT

BACKGROUND OF THE INVENTION

The present invention relates to document reproduction machines and particularly to those employing automatic document transport and aligning apparatus.

Many reproduction machines are of the so-called convenience copier type. In the manufacture of such machines, operator convenience and efficiency can be a major factor in the commercial success or failure of such machines. One important operator convenience factor is the physical location of the master and the duplicated copies with respect to the operator. In general, it is desired that all copies handled by the machine have a reference edge close to the operator. Such reference edges are referred to as "front" reference edges.

The optics of duplicating machines in generating a duplicate reproduction of a master from a copy station employ optics which reverse the image of the master to the reproduction, such as on an electrostatic reproducing drum. Such image reversal also reverses the reference edge from being a front reference edge to being a rear reference edge. Such a rear reference edge creates operator inconvenience, particularly in exit stations and collators forming a portion of a reproduction machine. For example, a rear reference edge means that the duplicate copies will be at the rear of the machine such that the operator may have to look inside the machine for examining the duplicate copies or for retrieving same from an exit station or collator. Operator convenience is greatly enhanced if all reference edges with which the operator must normally function are front reference edges.

SUMMARY OF THE INVENTION

It is an object of the invention to provide a document reproduction machine with a minimal volumetric and space requirement employing image reversal and front edge referencing in a copy station and in any exit station.

In accordance with the present invention, a document reproduction machine has a copy station employing front edge referencing capable of handling documents of diverse lengths. The optical paths for a reproduction station are of the image-reversing type. The reproduction station supplies duplicate copies employing a rear reference edge. Intermediate the reproduction station and an exit station is a transfer station having an aligner which moves the reference edge to the front reference edge irrespective of the diverse document lengths for exiting with a maximal operator convenience.

In a specific form of the invention, the aligner in the transfer station has a plurality of whiffle guiding members for translating documents from a rear to a front reference edge position in a minimal document transport distance without the aligning document transport. The guiding members are preferably disposed at about 45° to the usual direction of document motion. The exit station adjacent the aligner may include collation apparatus.

The foregoing and other objects, features, and advantages of the invention will become apparent from the following more particular description of the preferred embodiment of the invention, as illustrated in the accompanying drawing.

The Drawing

Figure 2:
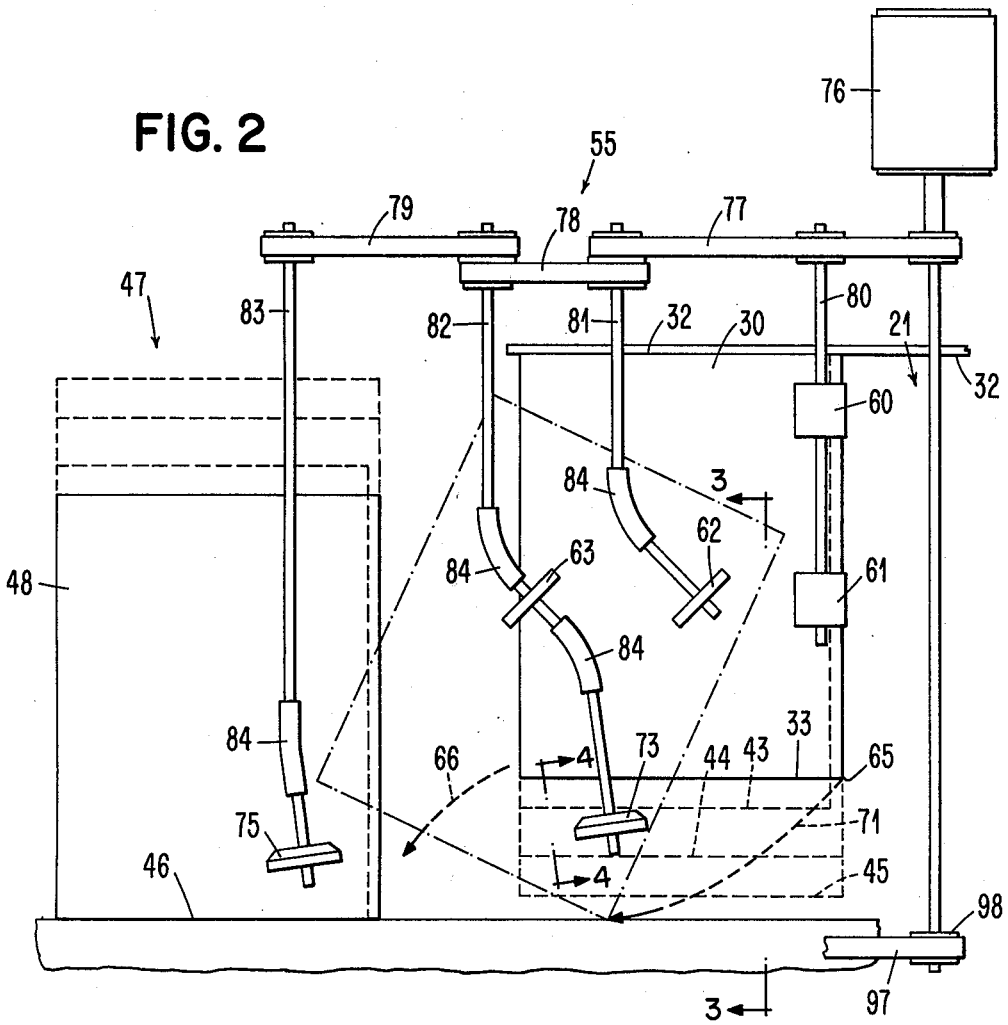
FIG. 2 is a diagrammatic plan view of an aligner for a transfer station preferred to be used in practicing the present invention.
Figure 4:
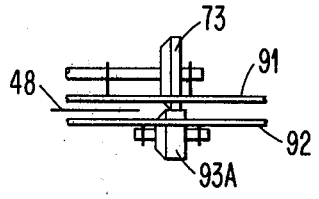

FIG. 4 diagrammatically illustrates the coaction between a driven roller and an idler roller as seen in the direction of the arrows along line 4—4 in FIG. 2.

Figure 1:
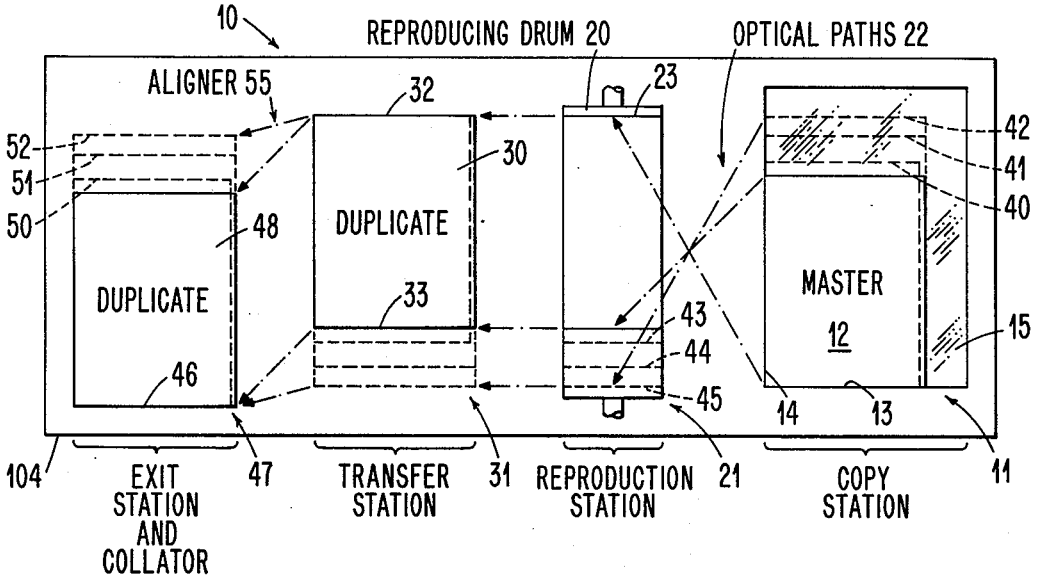
FIG. 1 is a diagrammatic showing of a machine employing the present invention.
Figure 5:
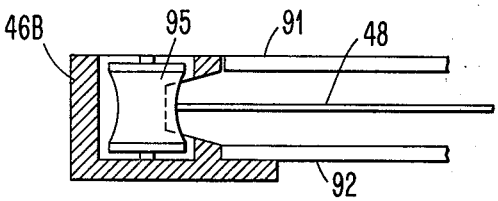
Figure 6:
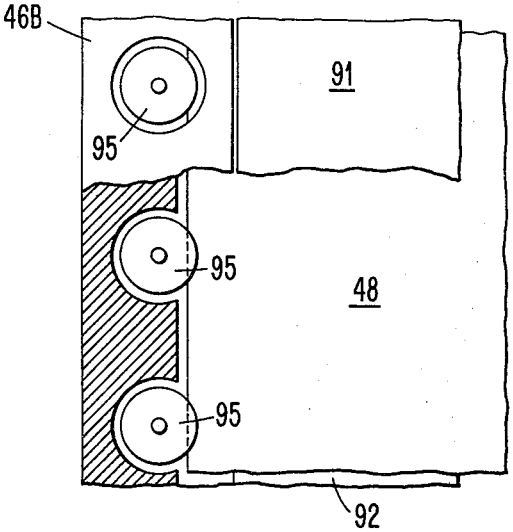
Figure 7:
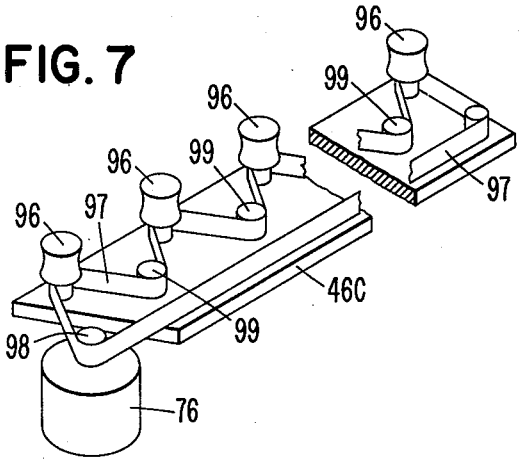

FIGS. 5, 6, and 7 illustrate antifriction edge guiding constructions usable in the FIG. 1 illustrated machine.

Figure 8:
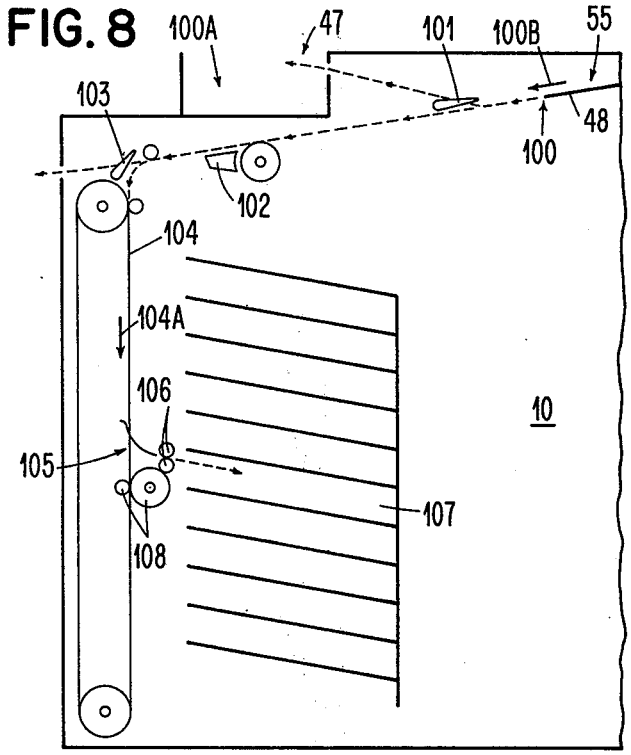

FIG. 8 diagrammatically shows a collator-type exit station usable with the FIG. 1 illustrated machine which advantageously employs front edge document referencing.

DETAILED DESCRIPTION

Referring more particularly to the drawing, like numerals indicate like parts and structural features in the various views and diagrams. Document reproduction machine 10 has a copy station 11 for receiving a master document 12 to be aligned at a front reference edge 13, preferably against a side reference edge 14. Platen 15 is transparent, allowing the facedown master 12 to be optically transferred to an electrostatic reproducing drum 20 in reproduction station 21. Stations 11 and 21 are constructed as those in a known electrostatic convenience copier, such as shown in U.S. Pat. No. 3,834,807. The optical paths 22, along which the image from master 12 is transferred to reproducing drum 20, is of the image-reversing type (uses a lens), well known in electrostatic copiers. As such, the front reference edge 13 of master 12 is transferred to a rear reference edge, as at 23, on drum 20. The duplicate copy made from the image on drum 20 leaves reproduction station 21 at the rear reference edge 23 such that duplicate copy 30 in transport station 31 is transported along a rear reference guide, as at 32. For operator convenience, it is desired that the opposite end 33 of duplicate copy 30 be at a front reference edge 46.

It is preferred that document reproduction machine 10 can handle various-length masters, such as indicated by dotted lines 40, 41 and 42, respectively, for B-size 13 and 14 inch size, paper. As such, duplicate copy paper is also selected from a plurality of paper sources (not shown) housed in machine 10. The duplicated image on the drum 20 has corresponding lengths indicated by dotted lines 43, 44 and 45. It is desired to align the front edge of duplicate copy 30 irrespective of duplicate copy lengths 33, 43, 44, and 45 with a given front edge 46 in exit station 47. Duplicate copy 48 is shown in the desired position with dashed lines 50, 51, and 52, respectively representing various duplicate copy lengths. An aligner 55 in station 31 translates document 30 to station 47 while reversing the edge referencing from rear to front. The FIG. 2 illustrated aligner transversely transports the documents between stations 31 and 47 in a minimal transport length for minimizing the size of machine 10.

Referring to FIG. 2, aligner 55 is just receiving a document 30 from reproduction station 21 under the influence of driven exit rollers 60 and 61. Document 30 is referenced to rear reference edge 32. In the FIG. 2 illustrated position, document 30, which is still under the influence of driven rollers 60 and 61, is also being engaged simultaneously by 45°-angled drive rollers 62 and 63. As soon as document 30 leaves rollers 60 and 61, angled whiffle rollers 62 and 63 translate document 30 toward front reference edge 46 at a velocity equal to the forward transport velocity imparted to document 30 by rollers 60 and 61. As a result, document 30 moves at a 45° angle; edge 33 remains substantially parallel to front edge 46 as document 30 translates toward the front reference edge position. To achieve the above-described action, rollers 62 and 63 have a peripheral speed of about $\sqrt{2}$ times the peripheral speed of rollers 60 and 61. For the same diameter rollers, the rotational speed varies by $\sqrt{2}$.

Roller 73 being disposed at less than 45° to front reference edge 46 has a greater forwad speed component than rollers 60-63; therefore, when it engages document 30, corner 65 moves rapidly to front reference edge 46, such as shown by the FIG. 2 dashed line box. A primary purpose of roller 73 is to prevent longer documents from nose-diving into edge 46. That is, as soon as a longer document, such as indicated by dashed line 45, leaves rollers 60 and 61, rollers 62 and 63 engaging the document closer to the rear edge 32 than front edge 45, a forward rotating torque is indicated by arrow 66. This torque drives the longer documents into front reference edge 46, causing crinkling or so-called "nose-diving," yielding machine document transport malfunctions. Aligner 55 overcomes this problem by high forward speed component wheel 73 (disposed at about 15° with respect to normal document transport direction) engaging the longer documents substantially simultaneously with the release of such documents by rollers 60 and 61. Wheel 73, rotating at a greater forward speed than rollers 62 and 63, pulls corner 65 along path 71 to front reference edge 46. Using the above arrangement, aligner 55 successfully operates with heavy bond paper, onionskin paper, and the so-called Mylar optical transparencies. Aligner 55 output drive wheel 75 is disposed at a small angle with respect to front reference edge 46 to ensure that the document is maintained firmly against the front reference edge when entering exit station 47.

Figure 3:
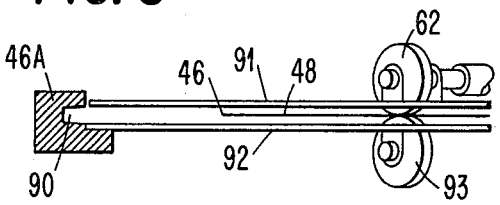
FIG. 3 is a simplified diagrammatic sectional view of the FIG. 2 illustrated aligner as taken in the direction of the arrows along lines 3—3 of FIG. 2.

The driven rollers in aligner 55 are powered by a motor 76 via drive belts 77, 78, and 79. Drive shafts 80, 81, 82, and 83 are secured to the driven rollers for rotations, as shown. The enlarged portions 84 are flexible couplings. Each portion of the shafts are journaled for rotation by means not shown. As will be described, each of the drive rollers 62, 63, 73, and 75 have a corresponding idler roller beneath the transport path as best seen in FIG. 3. Drive rollers 60 and 61 do not have opposing idlers, rather idler rollers (not shown) are displaced from the drive rollers in a known manner.

Rollers 62 and 63 are aligned with roller 61 between edges 32 and 33 of a short document 30. Roller 73 is disposed substantially as shown to engage a longer document as the longer document leaves rollers 60 and 61.

Referring next to FIG. 3, a cross-sectional view of aligner 55 shows some aligner constructional details. Front reference edge 46 is determined by a front reference guide 46A having a longitudinal channel 90 for receiving and guiding a document. Front reference edge 46 extends longitudinally of guide 46A. Document 48 is vertically constrained by a pair of document path forming plates 91 and 92. Opposite driven roller 73 is an idler roller 93 spaced therefrom in accordance with known design procedures for effectively transporting document 48, as above described. Angulation of driven roller 73 and idler roller 93 is not shown in FIG. 3. Each of the drive rollers 62, 63, 73, and 75 has a corresponding idler roller as shown in FIGS. 3 and 4 for effecting document transport. Both rollers 73 and 75 are preferably shaped as shown in FIG. 4 as rollers 73 and 93A. The chamfering facing the oncoming document 48 facilitates side document entry between the rollers. Also, see the roller construction shown in U.S. Pat. No. 3,148,877.

For further enhancement of document transport through aligner 55, antifriction rollers or driven rollers can be inserted into front reference edge guide member 46A. As shown in FIG. 5, a plurality of idler rollers are journeled for rotation on a vertical axial within front edge guide member 46B. The rollers are preferably concave shaped for centering document 48 intermediate plates 91 and 92, as shown in FIG. 5. As best seen in FIG. 6, rollers 95 are rotated by the movement of document 48 through aligner 55. In FIG. 7, motor 76 not only drives rollers 60, 61, 62, 63, 73, and 75, but also a plurality of edge guiding rollers 96 disposed in yet a third configuration of front edge reference guide member 46C. The relationship of driven rollers 96 to document 48 is the same as shown in FIG. 6 for rollers 95 with respect to document 48. A drive belt 97 extends from a capstan 98 of motor 76 to each and every driven roller 96 with intermediate idler belt tensioning rollers 99.

FIG. 8 diagrammatically illustrates a preferred exit station for duplicating machine 10. Aligner 55 is disposed immediately adjacent exit station 47. As documents leave aligner 55, as at 100, deflector 101 selects one of two paper paths. When in a downward position, document 48 is deflected upwardly into a noncollate duplicate copy collection bin 100A, copy side up. In a collate mode, deflector 101 is in the illustrated upward position such that copies 48 continue along path 100 rather than entering noncollate collection bin 100A. In this regard, aligner 55 has moved the document from the rear reference edge to the front reference edge in about five inches of motion in the direction of arrow 100B. Along path 100, drive rollers (not shown) continue moving document 48 toward second deflector 102. Deflector 102, in the illustrated position, permits the document 48 to pass further on document travel path 100 to third deflector 103. Deflector 103 being in the up position guides document 48 downwardly into operative engagement with vacuum belt 104 which holds the document as it is transported downwardly, as indicated by arrow 104A. Indexing vane 105 intercepts a document 48 held on belt 104 for deflecting it to move between a pair of driven feed rollers 106, thence into a selected collate bin 107. Rollers 106 receive rotary motion from a pair of driving rollers 108 which are in drive-receiving contact with vacuum belt 104. Vane assembly 105 moves vertically such that one document at a time is sequentially placed in successive ones of the bins, either in a downward or upward motion. Operation of vane 105 is not essential to understanding the operation of the invention, hence, will be dispensed with. Further, alternate positions of deflectors 102 and 103 yield exit station functions not necessary to the understanding of the invention and are not further explained for that reason. With front edge alignment, it can be ascertained from examination of FIG. 8 that all of the documents in bins 107 are easily visually inspected and removed by an operator from the front of the machine, as defined by line 46 of FIG. 1.

While the invention has been particularly shown and described with reference to a preferred embodiment thereof, it will be understood by those skilled in the art that various changes in form and detail may be made therein without departing from the spirit and scope of the invention.

What is claimed is:

1. A document reproduction machine having a copy station for receiving a master alignable along a front reference edge, reproduction means operatively associated and in optical communication with the copy station for creating duplicate images of said master, said optical communication causing an image reversal whereby said front reference edge becomes a rear reference edge, the improvement comprising:

first drive means for removing a duplicate copy from said reproduction station along said rear reference edge and transporting same in a first direction somewhat parallel to said rear reference edge;

an aligner contiguous with said reproduction station and having means establishing a front reference edge substantially contiguous with said reproduction station;

second drive means in said aligning station for moving a document received from said reproducing station from said rear reference edge to said aligner front reference edge and disposed at about 45° with respect to said rear reference edge;

an additional drive roller disposed between second drive means and said aligning station front reference edge for accommodating variable length documents to be aligned; and an exit station contiguous with said aligner for receiving documents aligned with said aligner front reference edge.

2. The document reproduction machine set forth in claim 1 wherein said second drive means is disposed approximately midway between said rear and said front aligning edge.

3. The document reproduction machine set forth in claim 2 wherein said second drive means has two driven rollers both of which are substantially midway between said rear and said front aligning edges.

4. The document reproduction machine set forth in claim 3 wherein said additional drive roller is disposed intermediate said front aligning edge and one of said second drive means driven rollers and being disposed less than 45° with respect to said rear reference edge for imparting a greater force and velocity along said first direction to documents engaged thereby than imparted by said second drive means.

5. The document reproduction machine set forth in claim 1 wherein said second drive means is in juxtaposition to said first drive means for initiating aligning action substantially at said reproduction station.

6. The document reproduction machine set forth in claim 1 further having front aligning means at said front reference edge including document transport enhancing means for facilitating maintaining document transport through aligning during document front edge alignment.

* * * * *